United States Patent [19]

Herrmann, Jr.

[11] 4,333,702

[45] Jun. 8, 1982

[54] LOW COST HIGH VOLTAGE CONNECTOR

[75] Inventor: Henry O. Herrmann, Jr., Elizabethtown, Pa.

[73] Assignee: AMP Incorporated, Harrisburg, Pa.

[21] Appl. No.: 133,368

[22] Filed: Mar. 24, 1980

[51] Int. Cl.[3] ..... H01R 13/627

[52] U.S. Cl. ..... 339/217 R; 339/206 R

[58] Field of Search ..... 339/17 C, 17 LC, 177 R, 339/177 E, 206 P, 207 R, 217 R, 217 S, 210 M

[56] References Cited

U.S. PATENT DOCUMENTS

| | | | |
|---|---|---|---|
| 3,697,933 | 10/1972 | Black et al. | 339/17 C X |
| 3,963,296 | 6/1976 | Glover et al. | 339/75 M |
| 4,008,941 | 2/1977 | Smith | 339/17 LC X |
| 4,171,152 | 10/1979 | Geiseler | 339/17 C X |
| 4,225,209 | 9/1980 | Hughes | 339/17 LC X |

*Primary Examiner*—Eugene F. Desmond

*Attorney, Agent, or Firm*—Russell J. Egan

[57] ABSTRACT

A high voltage connector is disclosed which can be fabricated by low cost production methods. The subject connector has a header, which can be snap assembled to a circuit board or the like, and a plug member mating therewith. The plug member is formed by a housing which defines a plurality of cavities and a like plurality of snap-in terminal carrying members each received in a respective cavity. The subject connector can employ economical stamped and formed terminals and obviate the previous necessity for insert molding of the housing around terminated wires.

12 Claims, 9 Drawing Figures

LOW COST HIGH VOLTAGE CONNECTOR

BACKGROUND OF THE INVENTION

1. The Field of the Invention

The present invention relates to high voltage connectors and in particular to a high voltage connector which can be manufactured by more economical means than has been previously available.

2. The Prior Art

The past practice for making high voltage connectors has generally been to injection mold a housing of polyethelene or polypropylene around an insert of at least one terminated wire. Because the terminal is molded in place, it must be of such construction that it will not be adversely affected by the molding process. Therefore, it is generally necessary to use an expensive screw machine formed part or accept poor reliability with low cost stamped and formed parts. It is also very expensive to form such connectors in that they are virtually unrepairable once they are manufactured.

SUMMARY OF THE INVENTION

It is the intent of the present invention to form a low cost, high voltage connector having a header and matable plug member. The plug member has a housing which defines a plurality of cavities and a like plurality of terminal carrying inserts, each of which is received in a respective cavity to define a long creepage path for a respective terminal. The terminal carrying inserts are snap fitted into the cavities of the plug housing. The terminals received in the inserts are preferably stamped and formed. The header is profiled to receive stamped and formed terminals therein, to be snap fitted to a related circuit board or the like, and to matingly receive the plug member therein.

It is therefore an object of the present invention to obviate the previous insert molding requirements and produce a connector having parts separately molded from the wires and contacts thereby allowing a greater choice of materials for both connector parts and automatic molding operations.

It is another object of the present invention to produce a low cost, high voltage connector having snap together assembly permitting stocking of components for a wider range of cable configurations.

It is a further object of the present invention to produce a low cost, high voltage connector in which parts can be separately formed and snap fitted together and yet have adequate creepage paths for high voltages.

It is a still further object of the present invention to produce a low cost, high voltage connector which can be readily and economically manufactured.

The means for accomplishing the foregoing objects and other advantages of the present invention will be apparent to those skilled in the art from the following detailed description taken with reference to the accompanying drawings.

DETAILED DESCRIPTION OF THE PREFERRED EMBODIMENT

Figure 2:
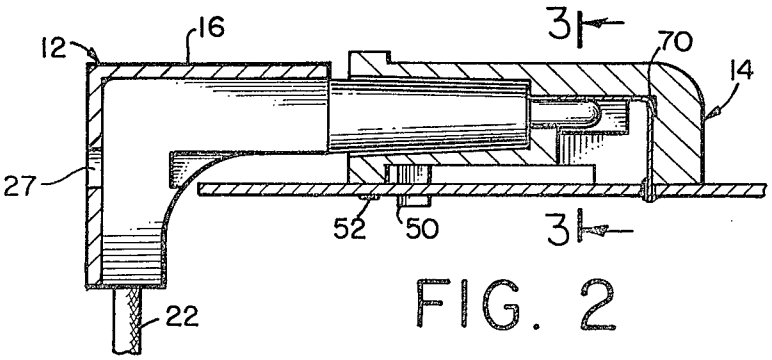
FIG. 2 is a transverse section taken along line 2—2 of FIG. 1.
Figure 3:
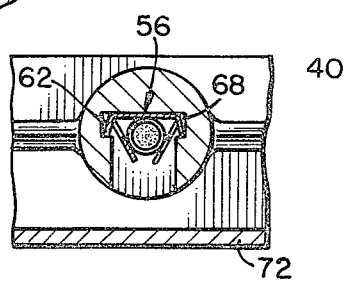
FIG. 3 is a detailed section taken along line 3—3 of FIG. 2.
Figure 1:
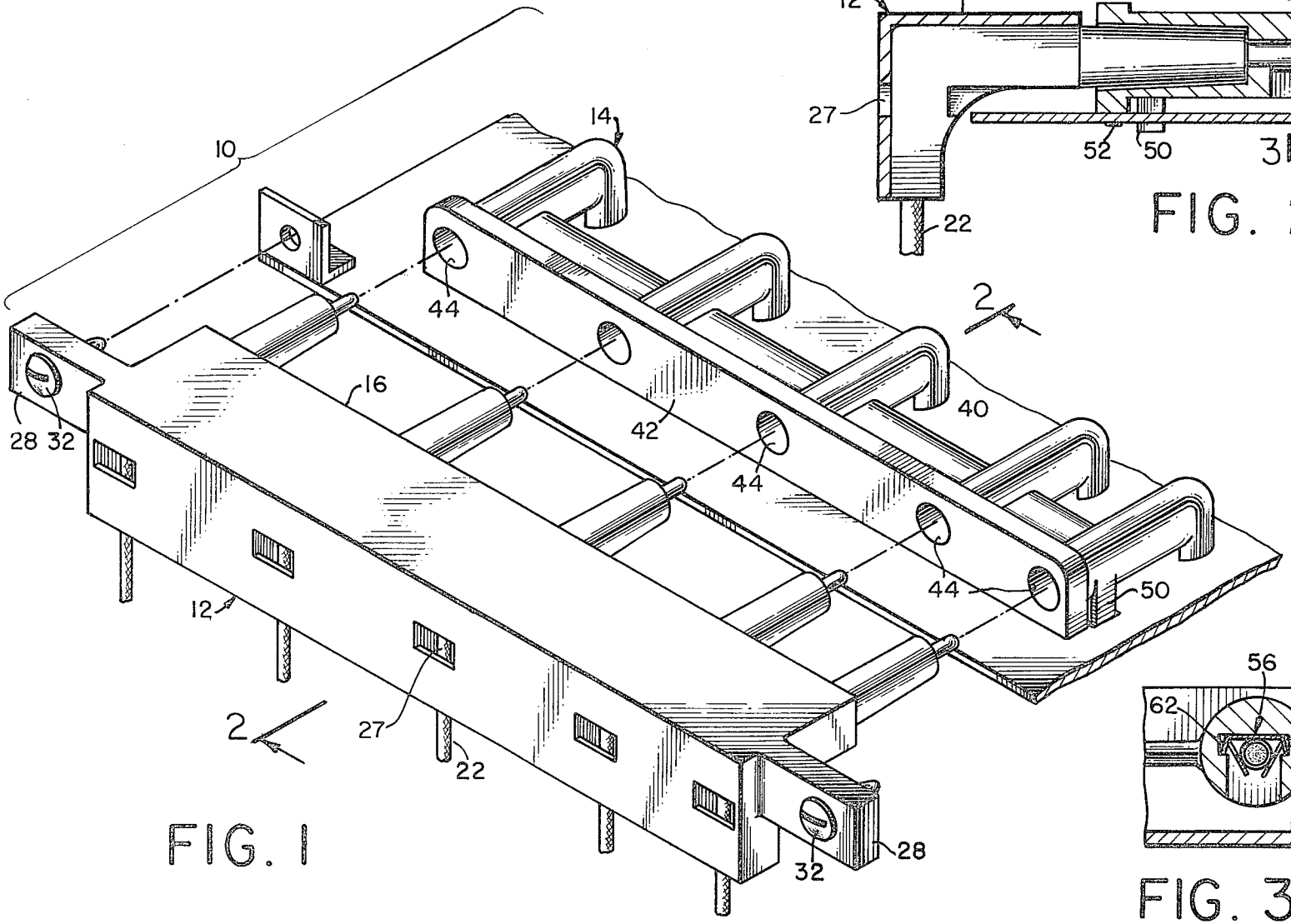
FIG. 1 is an exploded perspective view of the connector according to the present invention.

The subject connector 10 has a plug member 12 and a header 14. The plug member, shown in detail in FIGS. 4 to 6, includes a housing 16 having a plurality of inserts 18 with each of the inserts carrying a terminal 20 which terminates a cable or wire 22. The housing 16 is generally L shaped and defines a plurality of insert receiving cavities 24 therein with each recess having at least one latching lug 26 integrally formed therewith. Rear wall apertures 27 extend into each cavity 24, permitting the latching lugs 26 to be molded by a straight pull operation. The housing also includes mounting ears 28 at opposite ends thereof, each having a bore 30 receiving a mounting screw 32 therein. Each insert 18 has a profiled terminal bore 34 and a rearwardly directed cable or wire channel 36 intersecting the bore 34. The channel and bore have axes which are normal to one another and at their point of intersection there is a smooth surface of transition. Each insert 18 also includes latching detents 38 positioned to engage the latching lugs 26 of the housing 16.

Figure 8:
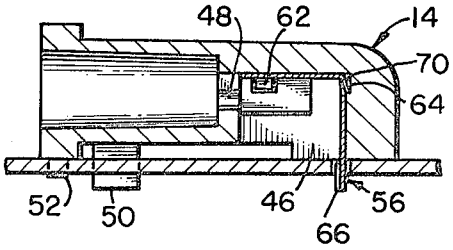
FIG. 8 is a section taken along line 8—8 of FIG. 7.
Figure 9:
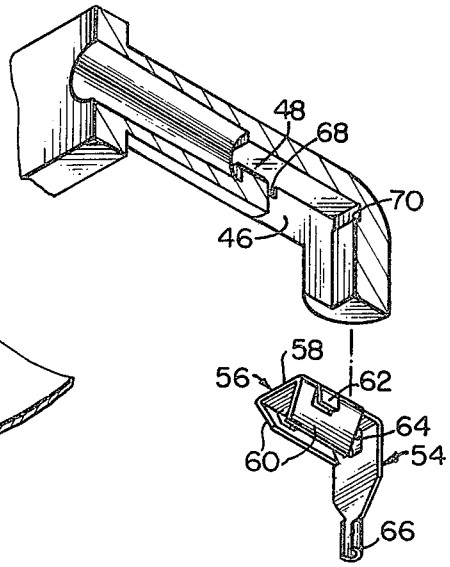
FIG. 9 is an exploded perspective view, partially in section, taken along line 9—9 of FIG. 7.
Figure 7:
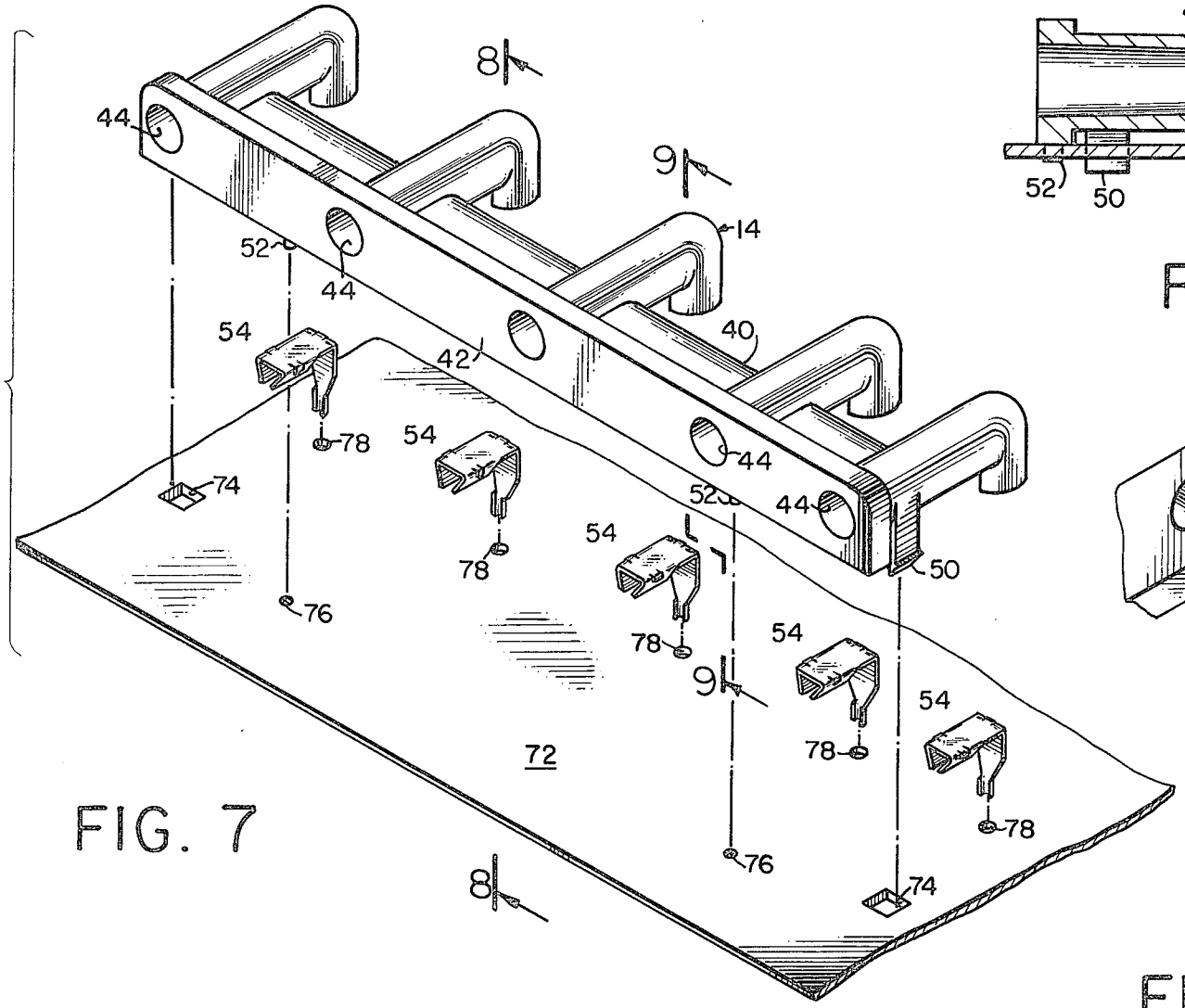
FIG. 7 is an exploded perspective view of the header of the subject invention.

The header 14, illustrated in detail in FIGS. 7 to 9, includes a housing 40 having a mating face 42 with a plurality of blind bores 44 opening therein. A terminal cavity 46 is formed to the rear of each bore 44 and is connected thereto by an aperture 48. The housing 40 is provided with downwardly directed mounting lugs 50 at each end and intermediate positioning pegs 52. A stamped and formed receptacle terminal 54 is mounted in each cavity 46 and includes a mating portion 56 formed by a web 58 and sidewalls 60, which are inwardly collapsed and which have side latching lugs 62 and rear latching lug 64 extending outwardly therefrom. The terminal further includes a depending solder tab 66. The terminals 54 are received in the respective cavities 46 with the lugs 62 engaging in side recesses 68 and lug 64 in rear recess 70. The mating portion 54 is thus aligned with the aperture 48 and bore 44.

The header is mounted on a circuit board 72 which is provided with a plurality of mounting holes 74, 76, 78 which receive the lugs 50, pins 52, and solder tabs 66, respectively.

Figures 4, 5, 6:
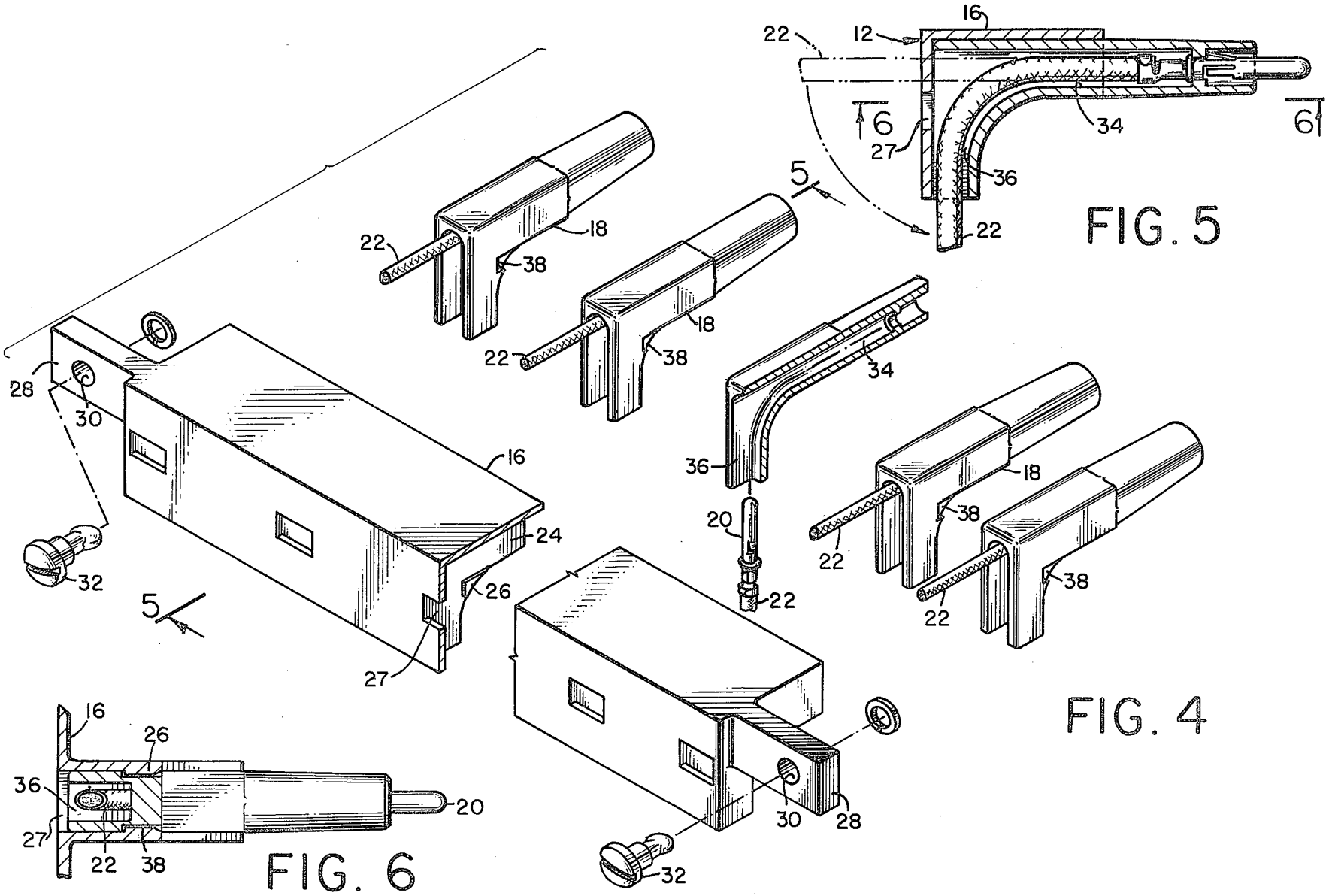
FIG. 4 is an exploded perspective view, partially in section, of the plug member of the subject invention.
FIG. 5 is a section taken along line 5—5 of FIG. 4.
FIG. 6 is a section taken along lines 6—6 of FIG. 5.

It will be appreciated, in particular from FIG. 4, that the subject connector does not require insert molding. Instead the individual pieces of the connector can be separately molded and stock piled for an assembly which can be customized according to requirements. For example, the housing 16 could be formed with a plurality of cavities 24 at regularly spaced intervals. Sufficient inserts 18 to meet the instant requirements could be then snap fitted into the cavities in the desired configuration. Thus it would not be necessary to insert mold a specialized part to meet a specialized configuration.

To assemble the subject connector, a plurality of terminated cables or wires 22 are applied to a like number of inserts 18. Each terminal 20 is placed in a respective bore 34 of the appropriate insert 18. The cable or wire 22 is then simply bent at right angles to lie in the channel 36. The thus completed insert 18 is simply snap fitted into the respective cavity 24 of the housing 16.

It will likewise be seen that the header is of very simple design and does not require insert molding of the terminals 54. The terminals 54 can simply be snap fitted into the respective cavities 46. As with the plug member, it can be foreseen that the header would be formed with a plurality of bores 44 and terminal cavities 46 on a closely spaced arrangement and then only those bores and cavities needed would be used with any one configuration. The header is simply mounted on a circuit board 72 by fitting the lugs 50 and pins 52 into their respective apertures 74, 76 and aligning the solder tabs 66 of the terminals 54 with their respective bores 78. The terminals would then be soldered to the circuitry of the circuit board by conventional means.

It should also be noted from FIGS. 2 and 5 that the subject connector provides a long creepage path so that high voltages can be handled in a satisfactory manner.

As is well known to those skilled in the art, exposed high voltage conductors must be isolated from the connector housing outer surfaces by a lengthy creepage path. Such a design prevents a corona developed by the high voltage from reaching the outer surfaces, a condition which would endanger anyone handling the connector. In the preferred embodiment, the critical creepage path extends from the rearward portion of a terminal 20, back along the surface of a wire 22 until it reaches a rear wall aperture 27. This distance has been designed to be of sufficient length to prevent a corona from reaching aperture 27, thereby eliminating the danger of electrical shock to the handler.

The present invention may be subject to many modifications and changes without departing from the spirit or essential characteristics thereof. The present embodiment should therefore be considered in all respects as illustrative and not restrictive of the scope of the invention.

What is claimed is:

1. A high voltage connector comprising:

a plug member having a housing defining a plurality of cavities therein, a plurality of inserts each received in a respective cavity, each insert having an intersecting bore and channel;

a like plurality of terminals each terminating a respective wire with said terminal being mounted in said bore and said wire extending through said channel; and a header having a mating face, a plurality of bores in said mating face, a cavity intersecting each said bore, and a terminal snap fitted into said cavity to such position where it can be engaged by a respective terminal in said plug member extending through said bore, and means for mounting said header on a circuit board or the like.

2. A high voltage connector according to claim 1 further comprising:

latching means in each said cavity and on each said insert whereby said inserts are detachably secured in said housing.

3. A high voltage connector according to claim 1 wherein said housing and said inserts are formed of insulative material.

4. A high voltage connector according to claim 1 further comprising: means to secure said plug member to said header.

5. A high voltage connector according to claim 1 wherein said terminals are all stamped and formed.

6. A high voltage connector according to claim 1 wherein said bore and channel of each said insert are of sufficient length so that a corona developed by a high voltage exposed at said terminal cannot reach the outer surface of said housing by travelling over a creepage path extending along the surface of said wire to the nearest exposure of said wire to the outer surface of said housing.

7. A high voltage plug comprising:

a housing defining a plurality of cavities of generally L shape, at least one latching means in each said cavity, a like plurality of inserts each having a bore and an intersecting channel defining an L shape, latching means on said insert member adapted to engage said latching means in said cavity, and a like plurality of terminals each terminating a respective wire, each said terminal being received in a respective bore of an insert with said conductor extending from said channel, said insert being received in a respective cavity of said housing and held therein by engagement of said latching means with said housing enclosing said channel.

8. A high voltage plug according to claim 7 wherein said housing and said inserts are molded from insulative material.

9. A high voltage plug according to claim 7 wherein said latching means comprises at least one lug in each said cavity and a mating recess on said insert.

10. A high voltage plug according to claim 7 wherein said bore and channel of each said insert are of sufficient length so that a corona developed by a high voltage exposed at said terminal cannot reach the outer surface of said housing by travelling over a creepage path extending along the surface of said wire to the nearest exposure of said wire to the outer surface of said housing.

11. A high voltage plug according to claim 7 further comprising means to secure said plug to a mating member.

12. A high voltage plug according to claim 7 wherein said terminals are stamped and formed.

* * * * *